US005303645A

United States Patent [19]

Meacham

[11] Patent Number: 5,303,645

[45] Date of Patent: Apr. 19, 1994

[54] ADJUSTABLE SHELVING SYSTEM HAVING FRICTION INCREASING MATING SURFACES

[75] Inventor: Thomas E. Meacham, Mountaintop, Pa.

[73] Assignee: Intermetro Industries Corporation, Wilkes Barre, Pa.

[21] Appl. No.: 883,176

[22] Filed: May 15, 1992

[51] Int. Cl.[5] ..... A47B 9/00

[52] U.S. Cl. ..... 100/144; 100/180

[58] Field of Search ..... 108/144, 111, 106, 107, 108/110

[56] References Cited

U.S. PATENT DOCUMENTS

| | | | |
|---|---|---|---|
| 3,604,369 | 9/1971 | Maslow | 108/144 |
| 3,757,705 | 9/1973 | Maslow . | |
| 4,318,352 | 3/1982 | Friedman et al. | 108/111 |
| 4,572,490 | 7/1985 | Tipton et al. | 108/111 |
| 4,595,107 | 6/1986 | Welsch | 108/144 X |
| 4,627,543 | 12/1986 | Nicely | 108/144 X |
| 4,629,077 | 12/1986 | Niblock | 108/144 X |
| 4,754,712 | 7/1988 | Olson et al. | 108/144 X |
| 4,763,799 | 8/1988 | Cohn et al. | 108/144 X |
| 4,964,350 | 10/1990 | Kolvites et al. | 108/144 X |
| 5,127,342 | 7/1992 | Taylor | 108/144 |

FOREIGN PATENT DOCUMENTS

| | | |
|---|---|---|
| 0201834 | 1/1987 | European Pat. Off. . |
| 9114545 | 2/1992 | Fed. Rep. of Germany . |
| 1149184 | 4/1969 | United Kingdom . |

*Primary Examiner*—José V. Chen

*Attorney, Agent, or Firm*—Fitzpatrick, Cella Harper & Scinto

[57] ABSTRACT

An adjustable shelving system has a plurality of generally cylindrical posts each having a plurality of vertically-spaced annular grooves therein and a plurality of tapered sleeves fitted on the posts. The tapered sleeves include an annular rib engageable with the annular grooves on the posts and an exterior mating surface. At least one plastic shelf has a plurality of tapered step holes for receiving one of the tapered sleeves fitted onto the post. The step holes are defined by an interior mating surface, and one of the exterior and interior mating surfaces is formed with a series of spaced cylindrical ledges to increase the friction between the sleeves and the step holes.

13 Claims, 3 Drawing Sheets

FIG. 1
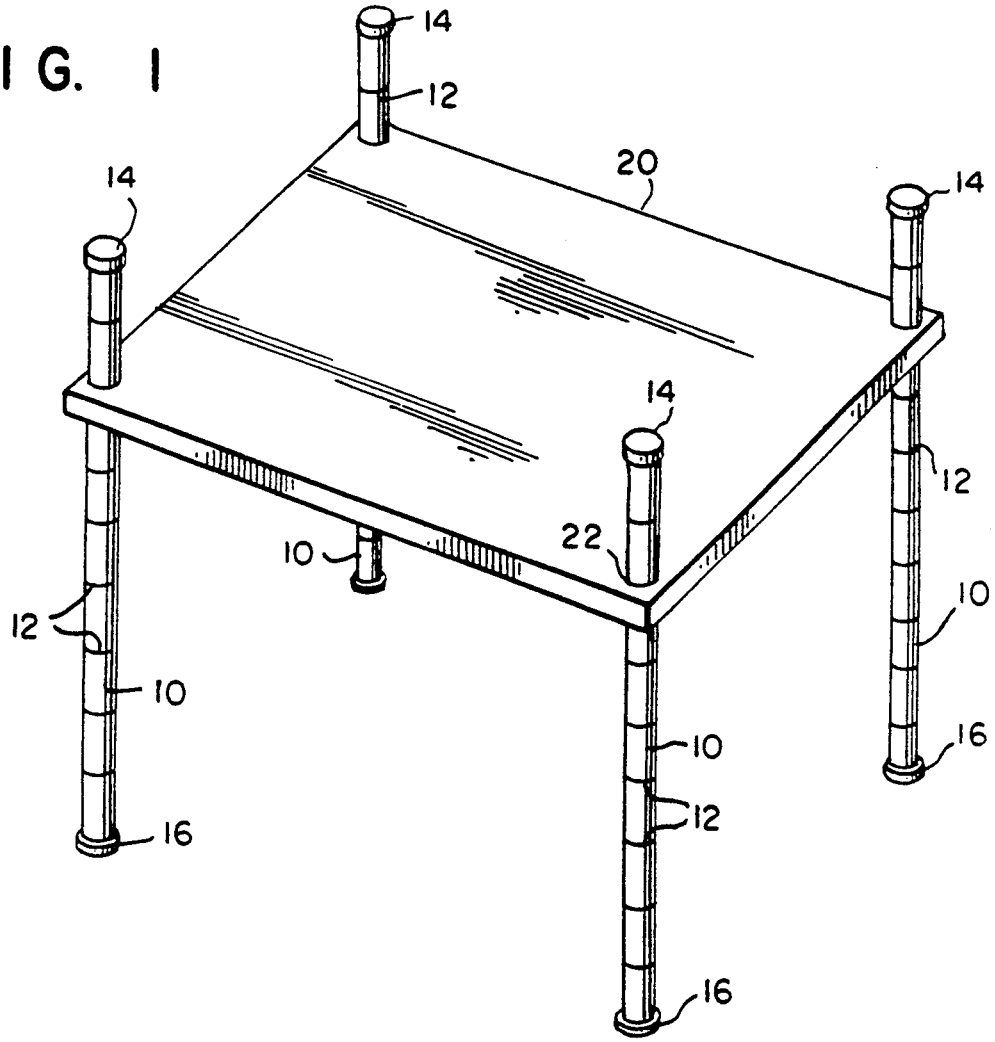
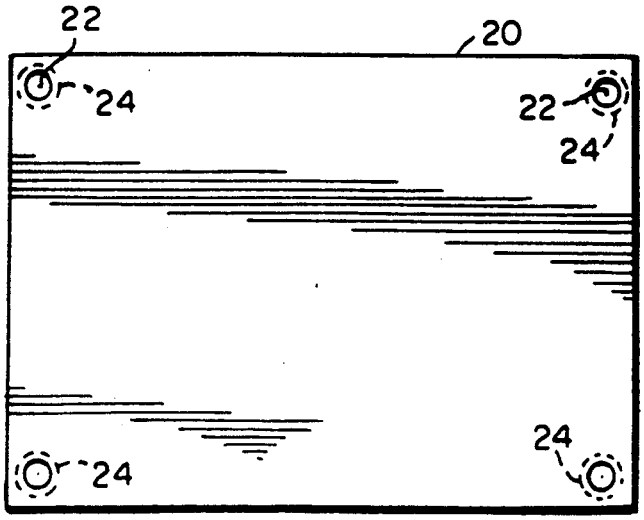
FIG. 2

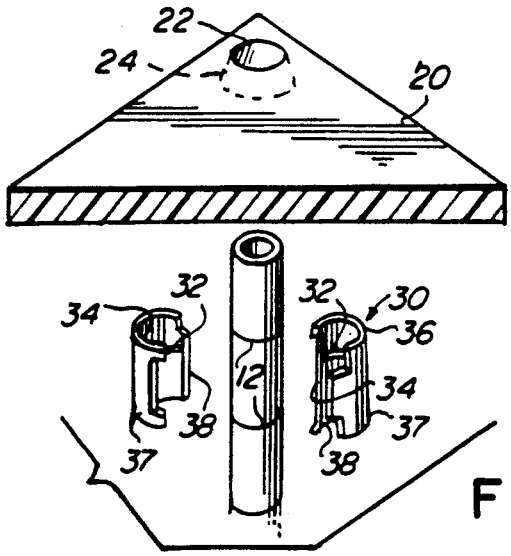
FIG. 4
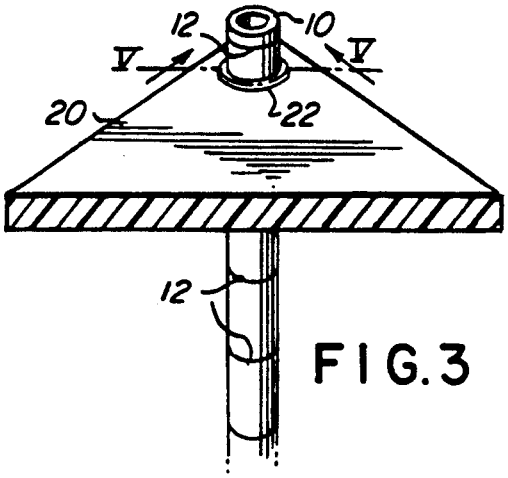
FIG. 3
FIG. 5
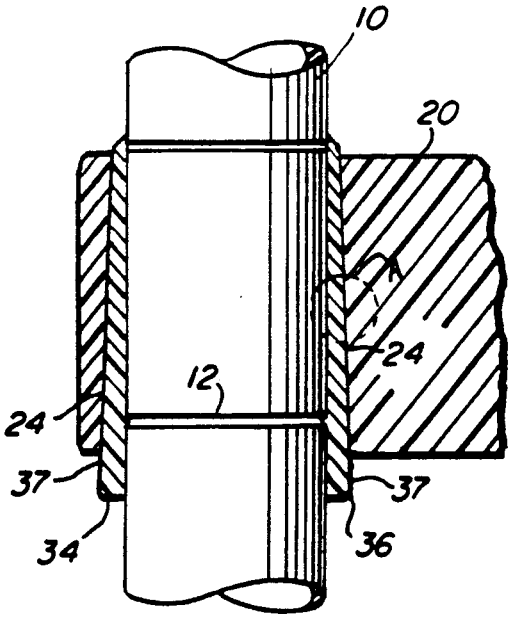
FIG. 6
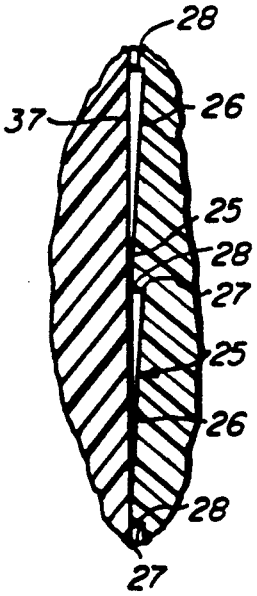

ADJUSTABLE SHELVING SYSTEM HAVING FRICTION INCREASING MATING SURFACES

BACKGROUND OF THE INVENTION

1. Field of the Invention

The present invention relates generally to an adjustable shelving system, and more particularly to an adjustable shelving system that uses plastic shelves. The use of plastic shelves is advantageous in many applications because they resist corrosion in otherwise corrosive environments. Plastic shelves also enhance design freedom while providing a sturdy structure. The adjustable plastic shelving system of the present invention is readily assembled and disassembled without tools to facilitate shipping, storage and cleaning.

2. Description of the Prior Art

Adjustable shelving systems are well known in the art. For example, U.S. Pat. Nos. 3,523,508 (Maslow) and 3,757,705 (Maslow) disclose such systems that have met with great commercial success under the trademark SUPER ERECTA SHELF of Applicant's Assignee, InterMetro Industries Corporation.

U.S. Pat. No. 3,523,508 discloses an adjustable shelving system comprising a formed-wire shelf component having a frustro-conically shaped collar at each corner for receiving a support post. Each collar tapers outwardly toward its lower extremity when viewed in normal use. Generally cylindrical support posts, each having a plurality of uniformly spaced annular grooves formed in its outer surface, are secured to the shelf by a mounting assembly. Each mounting assembly comprises at least two separate, complementary, conically-shaped mounting members which are joined about and at least partially surround the support post to define a sleeve. The outer surface of each sleeve is also frustro-conically shaped. Thus, the mounting sleeve is thickest at its bottom portion. The sleeves are sized to fit snugly within the shelf collars. A rib formed on an inside surface of each sleeve is sized to engage the annular groove formed on the support post.

To assemble the shelving system, sleeves are first placed about each support post such that the rib formed on the inside surface of each sleeve engages an appropriate groove in the support post. The support post with the sleeves mounted thereon is then passed through one respective collar at a corner of each shelf. The collars, sleeves and posts firmly engage each other due to their relative respective sizes. When all support posts are inserted, the shelving system is placed in position and ready for use. As the load on the shelf increases, a wedging action between the collars and sleeves produces a radially inwardly directed force exerted by the collars on the sleeves. This radially inwardly directed force securely locks the sleeves onto the posts.

U.S. Pat. No. 3,757,705 discloses an adjustable shelving system similar to that disclosed in U.S. Pat. No. 3,523,508, and further features the frustro-conical collar at each corner of the formed-wire shelf having a split wall. The split wall permits partial elastic lateral expansion within the collar to account for tolerance differences between the collar and the frustro-conical sleeve.

The shelving systems described above typically use plastic or metal materials for the posts and tapered sleeves, while the shelf is made of metal wire and the collar is made of metal sheet.

It is also known to use either solid or slotted plastic shelves in systems having components such as described above. Plastic shelves are lower in cost and weight. Such a system is shown, for example, in U.S. Pat. No. 4,964,350 (Kolvites) also assigned to InterMetro Industries.

However, plastic shelves have certain disadvantages. More particularly, the salient feature of the Maslow patents discussed above lies in the frustro-conical, or tapered, shape of the sleeve carried on the support post and the complementary shaped collar in the shelf. As the load supported by the shelve increases, the rigidity of the shelving system improves due to the noted wedging action between the tapered sleeve and complementary-shaped collar. However, that wedging action also produces a radially outwardly directed force exerted by the tapered sleeves on each collar of the shelf. Like the radially-inwardly directed force, the outwardly directed force increases as the load on the shelf increases. This outwardly directed force can cause a plastic shelf formed with plastic collars to crack or burst at its corners and fail. Therefore, further improvements in plastic shelf construction are needed.

SUMMARY OF THE INVENTION

It is an object of the present invention to provide an adjustable shelving system that improves upon shelving systems known in the art.

It is another object of the present invention to provide an adjustable shelving system that is readily assembled and disassembled with minimal effort, without tools, and provides high strength, stability and rigidity.

It is still another object of the present invention to provide an adjustable shelving system that uses plastic shelves that are economically fabricated, stable in use and readily cleaned.

It is still another object of the present invention to provide an adjustable shelving system with plastic shelves that can support substantial loads.

In accordance with one aspect of the subject invention, the preferred embodiment of the adjustable shelving system comprises a plurality of shelf-supporting posts, a plurality of tapered sleeves engageable at predetermined heights on the posts, with the sleeves having an exterior mating surface, and at least one plastic shelf having a plurality of tapered, stepped. surface holes or collars each receiving one of the shelf-supporting posts fitted with one of the sleeves. Each hole or collar is defined by an interior mating surface, and at least one of the exterior and interior mating surfaces are provided with a friction-increasing surface.

In accordance with another aspect of the present invention, the preferred embodiment of the adjustable shelving system comprises a plurality of shelf-supporting posts each having a plurality of vertically spaced annular grooves, and a plurality of tapered sleeves fitted on the posts, with each sleeve including an interior surface having an annular rib for engagement with the spaced annular grooves on the post and an exterior mating surface. Also provided is at least one plastic shelf having a plurality of tapered, stepped-surface holes or collars for receiving one of the tapered sleeves fitted onto the posts, with the collars in the shelf being defined by an interior mating surface. One of the exterior and interior mating surfaces of the sleeve and collar has a series of spaced cylindrical ribs that increase friction therebetween.

These and other objects, aspects, features and advantages of the present invention will become apparent from the following detailed description of the preferred embodiments taken in conjunction with the accompanying drawings.

BRIEF DESCRIPTION OF THE DRAWINGS

FIG. 1 is a perspective view of the adjustable shelving system in accordance with a preferred embodiment of the present invention;

FIG. 2 is a perspective view of a plastic shelf used in the adjustable shelving system of the present invention;

FIG. 3 is a fragmented perspective view of a corner of the adjustable shelving system shown in FIG. 1;

FIG. 4 is an exploded view of the corner of the adjustable shelving system shown in FIG. 3;

FIG. 5 is a fragmented sectional view taken along lines V—V of FIG. 4;

FIG. 6 is an enlarged view of the area A shown in FIG. 5; and

DESCRIPTION OF THE PREFERRED EMBODIMENTS

Figure 7:
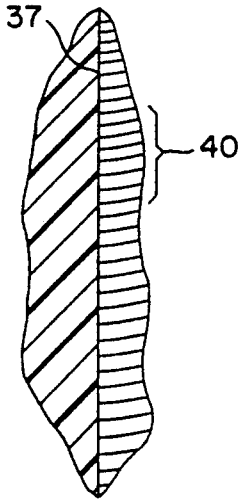
FIG. 7 is an alternative embodiment showing an enlarged view of the area A shown in FIG. 5.

FIG. 1 illustrates a preferred embodiment of the adjustable shelving system in accordance with the present invention. While the shelving system will be described in detail below, it generally comprises a plurality of generally cylindrical support posts 10 that can mount one or more shelves 20. A mounting assembly, or sleeve, 30 (best seen in FIG. 4) fits around each post 10 and is received in a collar or hole 22 in each corner of the shelf 20 to support the shelf on posts 10. As will be appreciated, the number of posts should correspond to the number of collars in the shelf, and while four collars are ordinarily provided in a standard rectangular shelf, the number of collars can vary depending on the shape of the shelf.

Each support post 10 is provided with a series of uniformly spaced annular grooves 12 extending substantially along its entire length. The annular grooves, which can be seen in FIGS. 1 and 3 through 5, receive complementary annular ribs 32 of sleeve 30 for securing the sleeve to the post. Decorative post caps 14 or post feet 16 can be optionally attached to support posts 10.

As shown in FIG. 4, each sleeve 30 is comprised of two separate, complementary mounting members 34, 36.

Mounting members 34, 36 have a downwardly outwardly frustro-conically-shaped exterior surface and are formed with a tongue 38 and groove 39 arrangement to fit together around post 10. The frustro-conical shape of sleeve 30 is best shown in FIG. 5. Each assembled sleeve tapers outwardly toward its lower extreme when viewed in normal use and is thickest at its bottom portion. The sleeve 30 is loosely secured to post 10 by engagement of the ribs 32 in one groove 12 and an exterior mating surface 37 is prepared to receive shelf 20.

The posts 10 can be made of metal or plastic and the sleeves 30 are preferably made of a plastic polymer material.

Shelf 20 of the present invention is shown in FIG. 2. The shelf is made of a plastic polymer material and provided with a frustro-conically tapered collar 22 in each corner. As shown in FIGS. 4 and 5, each collar 22 is defined by an interior mating surface 24. The interior surface is tapered in complementary fashion to lie tightly against the exterior surface 37 of the sleeve 34. The tapered angle of the interior and exterior surfaces 24, 37 is preferably 1° to 2°.

To assemble the shelving system, sleeves 30 are placed about each support post such that ribs 32 formed on the inside surface of mounting members 34, 36 engage grooves 12 on the posts 10 at the desired height. The posts 10 with sleeves 30 mounted thereon are then each inserted through one collar 22 at a corner of each shelf 20. The interior surfaces 24 defining each collar, the sleeves 30, and the posts 10 then firmly engage each other due to their relative respective sizes. When all support posts 10 are inserted, the shelving system is placed in upright position and is ready for use. At this point, the load from the shelf itself produces a wedging action between the tapered interior and exterior mating surfaces 24, 37. The wedging action provides a radially inwardly directed force to bring the sleeves 30 into locking relation with the posts 10 and an outwardly directed force is exerted by sleeves 30 on the collars. As the load on the shelf increases, both the radially-inwardly directed force and the outwardly directed force increase.

The shelving system as described thus far, while necessary to a full understanding of the present invention, is nonetheless conventional.

It has been recognized that when the shelf 20 is made of plastic the radially outwardly generated force between the sleeve and collar has an undesirable tendency to cause the collar to burst and thus fail. Therefore, in accordance with the subject invention, the plastic shelf 20 is designed in such a way that the radially outwardly directed force exerted by tapered sleeves 30 is limited to that below which will cause the collar to burst.

More particularly, it has been determined that the radially outwardly directed force between the sleeve and collar may be calculated as follows:

$$\text{Outward force} = \left[\frac{LOAD}{\tan(\text{taper angle})}\right] - \text{Force from friction}$$

The force from friction is directly proportional to the coefficient of friction between exterior surface 37 a sleeve 30 and the interior surface 24 defining a collar holes 22. Thus, In accordance with the subject invention, .the outward force is reduced by increasing the coefficient of friction between these two tapered surfaces.

The coefficient of friction between the two tapered surfaces can be increased in several ways in accordance with the present invention. More particularly, in a preferred embodiment, either the exterior surface 37 or the interior surface 24 is provided with a series of stepped cylindrical ribs 25. FIG. 6 illustrates each cylindrical rib 25 formed on interior mating surface 24 of the collar 22 while exterior surface 37 of the sleeve 30 is smooth. Each cylindrical rib is defined by a lateral wall 26 that terminates at its lower extreme in a horizontal ledge 28. The ribs 25 provide a superior gripping force as the ledges 28 increase the coefficient of friction between the two tapered surfaces. This gripping force prevents shelf 20 from excessively slipping down on the sleeve 30 as the shelf load increases. Thus, the outwardly directed force exerted by sleeve 30 is limited.

Generally speaking, the cylindrical ribs should be provided on the one of the exterior surface 37 of the sleeve 30 and interior surface 24 of the collar 22 made of the harder material between sleeve 30 and shelf 20 so that the ribs can press into or form indentations in the surface of the softer material.

Other means of increasing the coefficient of friction between the complementary tapered surfaces of the collars and sleeves are contemplated by the subject invention. For example, instead of cylindrical ribs, one of the interior or exterior surfaces can have other types of contoured surfaces, such as bumps or other generally raised portions, or both surfaces can be provided with a course, or roughened, surface such as by having a fine spiral "record-like" groove. A record-like groove 40 is shown in FIG. 7. Although specific embodiments of the present invention been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

I claim:

1. An adjustable shelving system, comprising:

a plurality of shelf-supporting posts;

a plurality of tapered sleeves engageable at predetermined heights on said posts, each said sleeve having an exterior mating surface;

at least one plastic shelf having a plurality of tapered step holes each receiving one of said shelf-supporting posts fitted with one of said sleeves, with each of the step holes being defined by an interior mating surface; and friction-increasing means provided on at least one of said exterior and interior mating surfaces by a spiral record-like groove.

2. An adjustable shelving system according to claim 1, wherein each said post has a plurality of vertically spaced annular grooves.

3. An adjustable shelving system according to claim 2, wherein each said sleeve comprises a pair of semi-annular members cooperating with each other to fit around said post, and said semi-annular members include a semi-annular rib formed on an interior surface thereof to be received in one of the spaced annular grooves in said post.

4. An adjustable shelving system according to claim 1, wherein said spiral record-like groove is provided on said exterior mating surface and said interior mating surface has a smooth finish.

5. An adjustable shelving system according to claim 1, wherein said spiral record-like groove is provided on said interior mating surface and said exterior mating surface has a smooth finish.

6. An adjustable shelving system according tot claim 1, wherein said record-like groove runs horizontally in planes substantially perpendicular to an axial center of said tapered sleeves.

7. An adjustable shelving system, comprising:

a plurality of shelf-supporting posts, each post having a plurality of vertically spaced annular grooves;

a plurality of tapered sleeves fitted on said posts, with each sleeve including an interior surface having an annular rib for engagement with the spaced annular grooves on said post and an exterior mating surface;

at least one plastic shelf having a plurality of tapered step holes each receiving one of said tapered sleeves fitted onto said post, with the step holes in said shelf being defined by an interior mating surface; and friction-increasing means provided on one of said exterior and interior mating surfaces by a series of stepped cylindrical ribs which are defined by a series of ledges which are vertically spaced by a tapered lateral wall.

8. An adjustable shelving system according to claim 7, wherein said sleeve includes a pair of partially-annular members cooperating with each other to fit around each said post.

9. An adjustable shelving system according to claim 8, wherein each said partially-annular member includes a partially-annular rib receivable in one of the spaced annular grooves of said posts.

10. An adjustable shelving system according to claim 7, wherein said tapered cylindrical ledges are provided on said exterior mating surface and said interior mating surface has a smooth finish.

11. An adjustable shelving system according to claim 7, wherein said tapered cylindrical ledges are provided on said interior mating surface and said exterior mating surface has a smooth finish.

12. An adjustable shelving system according to claim 7, wherein said tapered sleeves are made of plastic material and one of said exterior mating surface and said interior mating surface is made of a harder plastic material than said other mating surface, and said harder mating surface is provided with said tapered cylindrical ledges.

13. An adjustable shelving system according to claim 7, wherein said tapered cylindrical ledges run horizontally in planes substantially perpendicular to an axial center of said tapered sleeves.

* * * * *

UNITED STATES PATENT AND TRADEMARK OFFICE

CERTIFICATE OF CORRECTION

PATENT NO. : 5,303,645

DATED : April 19, 1994

INVENTOR(S) : THOMAS E. MEACHAM

It is certified that error appears in the above-identified patent and that said Letters Patent is hereby corrected as shown below:

THE TITLE PAGE

At [56] References Cited, Attorney, Agent, or Firm "Fitzpatrick, Cella Harper & Scinto" should read --Fitzpatrick, Cella, Harper & Scinto--.

COLUMN 1

Line 53, "radially inwardly" should read --radially-inwardly--.
Line 54, "radially inwardly" should read --radially-inwardly--.

COLUMN 4

Line 16, "radially" should read --radially- --.
Line 31, "radially outwardly" should read --radially-outwardly--.
Line 35, "radially outwardly" should read --radially-outwardly--.
Line 43, "surface 37" should read --surface 37,--.
Line 45, "holes 22." should read --22.-- and "In" should read --in--.

UNITED STATES PATENT AND TRADEMARK OFFICE

CERTIFICATE OF CORRECTION

PATENT NO. : 5,303,645

DATED : April 19, 1994

INVENTOR(S) : THOMAS E. MEACHAM

It is certified that error appears in the above-identified patent and that said Letters Patent is hereby corrected as shown below:

COLUMN 5

Line 13, "Although" should read --¶ Although--.

COLUMN 6

Line 5, "tot" should read --to--.

Signed and Sealed this

Twenty-eight Day of March, 1995

Bruce Lehman

*Attest:*

BRUCE LEHMAN

*Attesting Officer*

*Commissioner of Patents and Trademarks*